US007293862B2

(12) United States Patent
Lean et al.

(10) Patent No.: US 7,293,862 B2
(45) Date of Patent: Nov. 13, 2007

(54) RESERVOIR SYSTEMS FOR ADMINISTERING MULTIPLE POPULATIONS OF PARTICLES

(75) Inventors: Meng H. Lean, Santa Clara, CA (US); Osman T. Polatkan, N. Haledon, NJ (US); John J. Ricciardelli, Poughkeepsie, NY (US); Michael J. Savino, Tappan, NY (US)

(73) Assignee: Xerox Corporation, Stamford, CT (US)

( * ) Notice: Subject to any disclaimer, the term of this patent is extended or adjusted under 35 U.S.C. 154(b) by 340 days.

(21) Appl. No.: 10/977,216

(22) Filed: Oct. 29, 2004

(65) Prior Publication Data

US 2006/0092234 A1 May 4, 2006

(51) Int. Cl.
*B41J 2/175* (2006.01)
*B41J 2/06* (2006.01)

(52) U.S. Cl. ..... 347/85; 347/55

(58) Field of Classification Search ..... 347/21, 347/65, 85, 98, 55
See application file for complete search history.

(56) References Cited

U.S. PATENT DOCUMENTS 4,527,884 A 7/1985 Nusser
4,558,941 A 12/1985 Nosaki et al.
4,647,179 A 3/1987 Schmidlin
4,896,174 A 1/1990 Stearns
5,281,982 A 1/1994 Mosehauer et al.
5,400,062 A 3/1995 Salmon
5,717,986 A 2/1998 Vo et al.
5,850,587 A 12/1998 Schmidlin
5,893,015 A 4/1999 Mojarradi et al.
6,070,036 A 5/2000 Thompson et al.
6,112,044 A 8/2000 Thompson et al.
6,116,718 A 9/2000 Peeters et al.
6,134,412 A 10/2000 Thompson
6,137,979 A 10/2000 Garstein et al.
6,219,515 B1 4/2001 Lestrange
6,246,855 B1 6/2001 Gartstein et al.
6,272,296 B1 8/2001 Gartstein
6,290,342 B1 9/2001 Vo et al.
6,293,659 B1 9/2001 Floyd et al.
6,328,409 B1 12/2001 Peeters et al.
6,340,216 B1 1/2002 Peeters et al.
6,351,623 B1 2/2002 Thayer et al.
6,416,158 B1 7/2002 Floyd et al.
6,416,159 B1 7/2002 Floyd et al.
6,439,711 B1 8/2002 Carlini et al.
6,454,384 B1 9/2002 Peeters et al.
6,467,862 B1 10/2002 Peeters et al.
6,467,871 B1 10/2002 Moffat et al.
6,499,831 B2 12/2002 Schmidlin
6,511,149 B1 1/2003 Peeters et al.
6,521,297 B2 2/2003 McDougall et al.
6,523,928 B2 2/2003 Peeters et al.
6,598,954 B1 7/2003 Moffat et al.
6,719,399 B2 4/2004 Moffat et al.
6,751,865 B1 6/2004 Peeters et al.

*Primary Examiner*—An H. Do
(74) *Attorney, Agent, or Firm*—Fay Sharpe LLP

(57) ABSTRACT

Various particle reservoir systems such as used in printing systems are described which utilize one or more traveling wave grids within a reservoir to selectively transport particles to a reservoir exit. The traveling wave grids serve to transport the particles by use of moving electrostatic fields that travel across the grids. The reservoir systems are adapted for use with a variety of print head configurations.

7 Claims, 5 Drawing Sheets

RESERVOIR SYSTEMS FOR ADMINISTERING MULTIPLE POPULATIONS OF PARTICLES

BACKGROUND

The present exemplary embodiment relates to the dispensing or administration of two or more populations of particles. It finds particular application in conjunction with the printing arts, and will be described with particular reference thereto. However, it is to be appreciated that the present exemplary embodiment is also amenable to other like applications such as the pharmaceutical processing of medication as in the "printing" of pills.

BRIEF DESCRIPTION

In accordance with one aspect of the present exemplary embodiment, a reservoir system adapted for use in a printing system is provided. The reservoir system comprises a reservoir body defining an interior hollow region adapted to store particles and a channel. The hollow region and the channel are in flow communication through a particle feed exit. The reservoir system also comprises a traveling wave grid assembly disposed within the interior hollow region. The traveling wave grid assembly is adapted to transport particles in the hollow region defined in the reservoir body to a location proximate the particle feed exit. The traveling wave grid assembly includes a non-planar traveling wave grid that serves to recirculate and provide a continuous, or nearly so, supply of particles to the location proximate the particle feed exit.

In accordance with another aspect of the present exemplary embodiment, a reservoir system is provided which is adapted for use in a printing system. The reservoir system comprises at least one member defining a hollow flow channel terminating at a channel exit. The reservoir system also comprises a collection of reservoir bodies, in which each reservoir body defines an interior hollow region adapted to store particles. The hollow region in the hollow flow channel are in flow communication through a particle feed exit. The reservoir system also comprises a collection of traveling wave grids. At least one of the collection of traveling wave grids is disposed within the interior hollow region of a corresponding reservoir body and positioned and configured to transport particles in the hollow region of the corresponding reservoir body to a location proximate the particle feed exit.

In accordance with yet another aspect of the present exemplary embodiment, a reservoir system adapted for use in a printing system is provided. The reservoir system comprises a collection of reservoir bodies, in which each body defines an interior hollow region adapted to store particles. The reservoir system also comprises a collection of corresponding gas channels. Each gas channel is dedicated to a respective reservoir body and in flow communication therewith through a particle feed exit. The reservoir system also comprises a collection of corresponding traveling wave grids. Each traveling wave grid is disposed in an interior hollow region defined within a respective reservoir body.

DETAILED DESCRIPTION

The exemplary embodiment provides systems and techniques for the storage, transport, and controlled distribution of small particles such as for example, toner particles. Although the exemplary embodiment is described in terms of the printing arts and transporting toner particles, it is to be understood that the exemplary embodiment includes other applications involving the storage, transport, or distribution of minute particles.

Several exemplary embodiment print head configurations are described herein. These print head configurations are particularly adapted for use in a powder ballistic aerosol marking (BAM) printer that can image onto an intermediate substrate or be used as a direct marking device. The exemplary embodiment print head configurations include single-shot color, two-shot color, and tandem color. A significant feature of the exemplary embodiment is the provision and incorporation of a multi-piece traveling wave grid for recirculating transport and cascade delivery of toner to one or more gating aperture arrays for on demand printing.

The term "traveling wave grid" as used herein collectively refers to a substrate, a plurality of traveling wave electrodes to which a voltage waveform is applied to generate the traveling wave(s), and one or more busses, vias, and electrical contact pads to distribute the electrical signals (or voltage potentials) throughout the grid. The term also collectively refers to one or more sources of electrical power, which provides the multi-phase electrical signal for operating the grid. The traveling wave grids may be in nearly any form, such as for example a flat planar form, or a non-planar form. Traveling wave grids, their use, and manufacture are generally described in U.S. Pat. Nos. 6,351,623; 6,290,342; 6,272,296; 6,246,855; 6,219,515; 6,137,979; 6,134,412; 5,893,015; and 4,896,174, all of which are hereby incorporated by reference.

Figure 1:
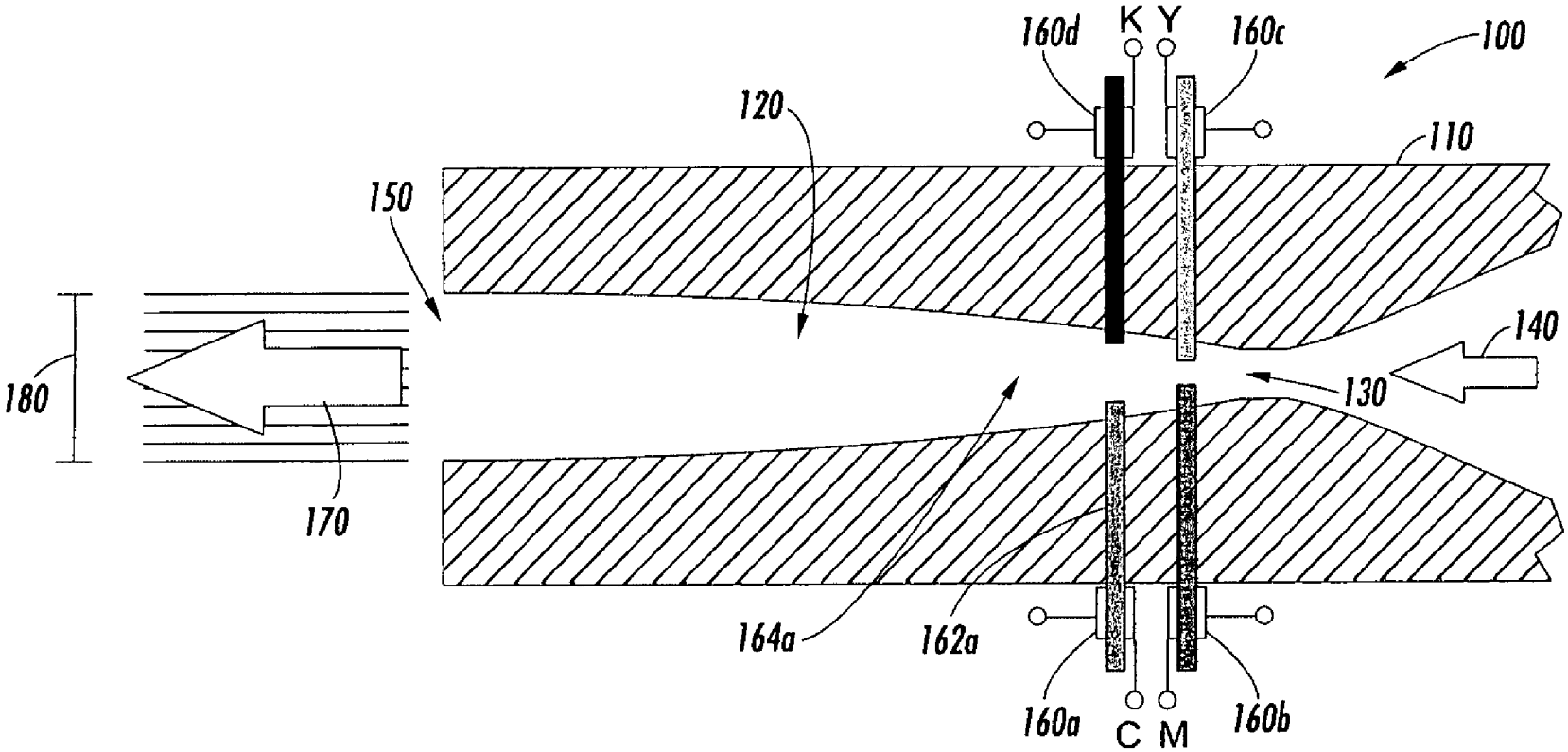
FIG. 1 is a schematic of a printing system utilizing an exemplary embodiment reservoir system.

Ballistic aerosol marking (BAM) is a technology being developed for high speed direct marking onto paper or onto an intermediate medium. BAM uses high-speed continuous gas jets to move small toner particles to the print medium. The toner is electrostatically gated on demand from apertures transverse to the gas channel. The print head is comprised of an array of individually controlled micro-channels, each of which is a Laval nozzle incorporating a Venturi structure (converging/diverging channel) to accelerate and focus the narrow gas jets. BAM is designed to be a true color CMYK printing system, whereby metered amounts of component colors for individual nozzles are injected on-demand into the jet stream at the same time to be conveyed to the print medium. A schematic of the process is shown in FIG. 1. Details and information relating to ballistic aerosol marking systems, components, and processes are described in the following U.S. Pat. Nos. 6,751,865; 6,719,399; 6,598,954; 6,523,928; 6,521,297; 6,511,149; 6,467, 871; 6,467,862; 6,454,384; 6,439,711; 6,416,159; 6,416,158; 6,340,216; 6,328,409; 6,293,659; and 6,116,718; all of which are hereby incorporated by reference.

Specifically, FIG. 1 illustrates a BAM printing apparatus 100 comprising a member 110 defining a hollow channel 120. As noted, the channel 120 is in the form of a Laval type expansion pipe through which pressurized gas flows, as indicated by arrow 140. The channel 120 includes a narrowed region 130, which is upstream of one or more feed apertures described below. The channel 120 terminates at an exit 150 at which the exiting gas flow, indicated by arrow 170, is discharged from the member 110. The apparatus 100 further comprises one or more toner supply and administering devices designated for example as 160*a*, 160*b*, 160*c*, and 160*d* through which toner types C, M, Y, and K are administered, respectively. Referring to device 160*a* for toner type C, for example, the toner is selectively delivered through a feed line 162*a* and exits at a venturi toner feed or pressure forced feed exit 164*a*. Control of toner through each of the devices 160*a*, 160*b*, 160*c*, and 160*d* can be provided by an electrostatic toner gate. During operation of the apparatus 100, a flow 140 of highly pressurized gas, for example $CO_2$ at 72 atmospheres, enters the channel 120 and specifically, the narrowed region 130. Toner is entrained in the gas flow as the flow passes the various toner feed exits, for example 164*a*. The pressure of the gas flow is reduced upon entering the expanded region of the channel 120 prior to the exit 150. As the gas leaves the exit 150, its pressure is for example, about 1 atmosphere. This is significant in that it results in the gas reaching its fully expanded volume. The exiting gas flow 170 is a focused, high velocity aerosol jet. Fusing of toner entrained in the flow can occur on impact with a substrate, such as 180, or fusing may occur while toner is in flight.

Although a high pressure gas at 72 atmospheres is noted, the exemplary embodiment reservoir systems can utilize high pressure gas sources at pressures less than or greater than that noted.

This technology can utilize high viscosity inks to minimize inter-color bleed. Since it is designed as a single-pass print engine, there is no additional requirement for color registration. Images are formed when the individually controlled micro-channels combine to lay down the component image patterns. Although in theory toners may be designed for kinetic fusing on impact, a working compromise is to lower gas pressure and optimize toner morphology together with paper preheat or print medium surface treatments to minimize backscatter or bounce-back of the toner on impact.

Figure 2:
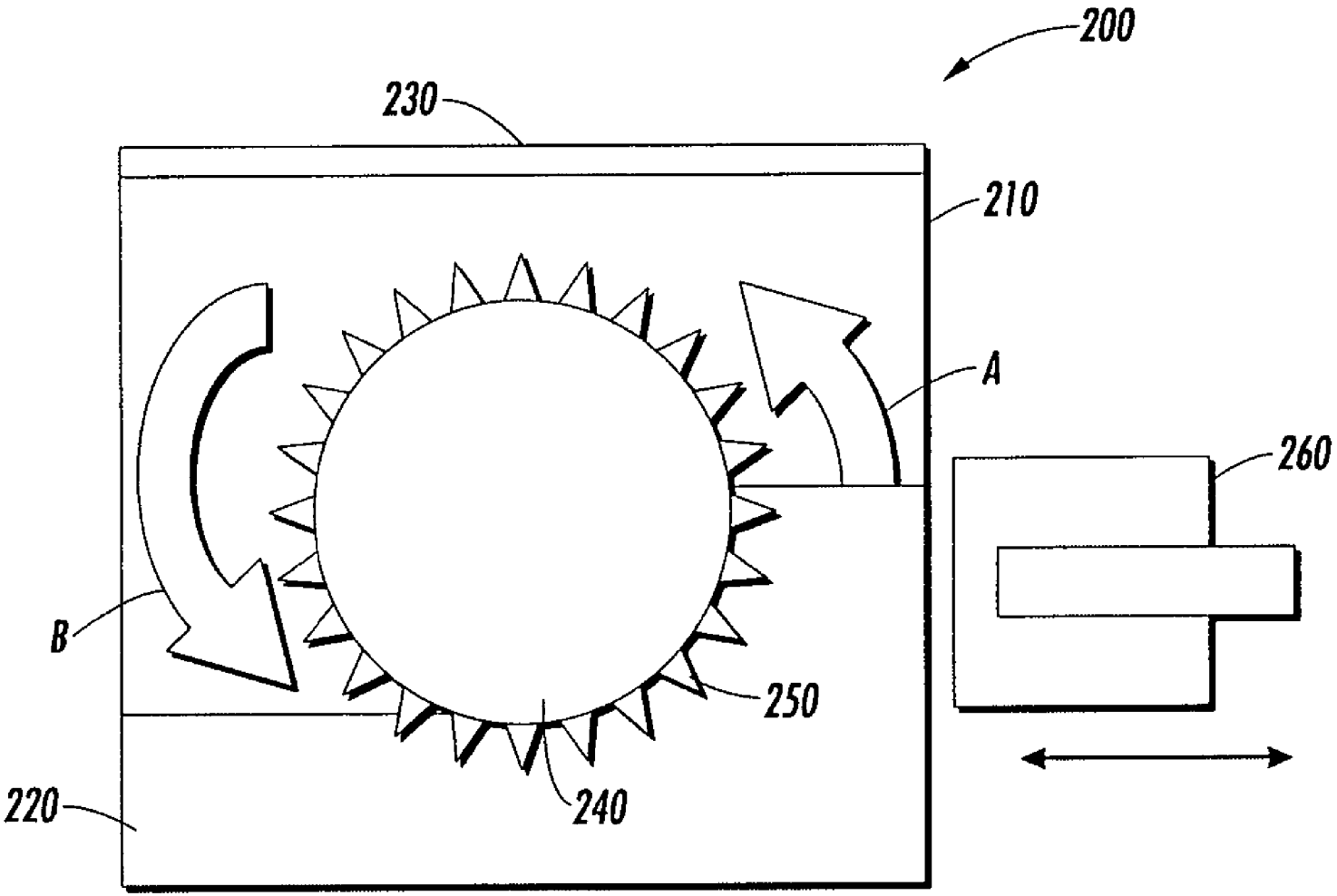
FIG. 2 is a schematic of an exemplary embodiment reservoir system.

Continuous line printing has been successfully demonstrated using an exemplary embodiment reservoir system. On demand gating into a 8× macro-channel and subsequent pixel printing has also been experimentally demonstrated using an exemplary embodiment reservoir system. In the latter, a re-circulating toner supply mechanism is fabricated using a traveling wave grid disposed on or about an Ultim roll for traveling wave transport and fluidization of the toner. FIG. 2 shows a schematic view of a toner re-circulating flow cell 200 in accordance with the exemplary embodiment. Specifically, the cell 200 comprises a body or enclosure 210 for housing or otherwise retaining toner, designated as a toner sump 220. The enclosure 210 also comprises an apertured plate 230 disposed along one of its faces. The cell additionally includes a member 240, which in the exemplary embodiment depicted in FIG. 2 is a cylindrical or roll member. The member 240 includes a region such as an outer circumferential surface about its periphery that includes a traveling wave grid 250. The cell 200 also comprises, or can be adapted to interface with, a toner loading component 260, such as a solenoid actuator that is configured to supply toner to the cell upon actuation of the solenoid. Upon operation of the cell 200, the activation of the traveling wave grid 250 transports toner from the sump 220 toward the apertured plate 230 in the direction of arrow A, at which the toner can be withdrawn or otherwise deposited. Remaining toner on the grid 250 is returned as shown by arrow B to the sump 220. The toner cloud resulting adjacent the traveling wave grid 250 in the cell 200 can be gated for example, using 2-φ voltage signals through electrodes providing 50 um apertures fabricated from a gold coated 2-mil Kapton film. The electrodes could be disposed in the plate 230. A 4-phase circuit is used to drive the traveling wave. These parameters are representative in nature and variations can be utilized in the exemplary embodiment.

Figure 3:
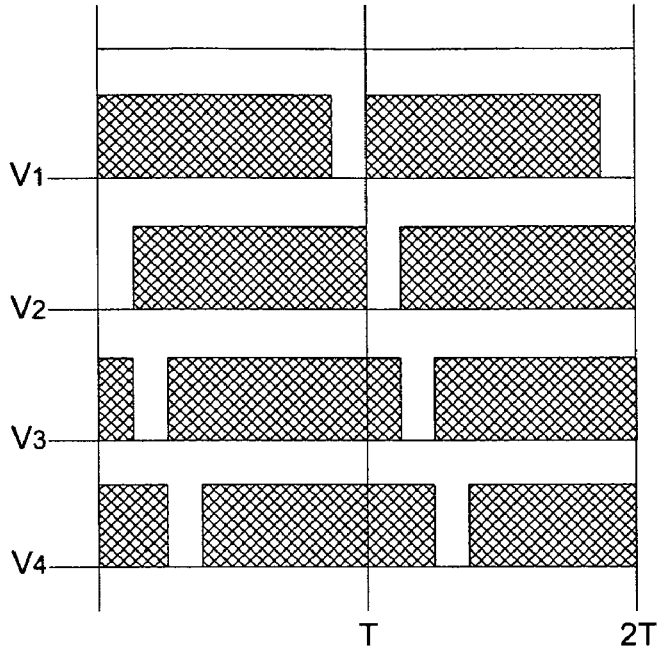
FIG. 3 is a graph illustrating a voltage waveform for use in an exemplary embodiment reservoir system.

FIG. 3 shows two cycles and representative voltage patterns for the traveling wave used in the exemplary embodiment. A 10 Hz wave frequency induces a toner wave velocity of 0.5 cm/s. The voltage pattern in FIG. 3 was applied at a 90 degree phase separation, a percentage duty cycle (w/t) of 50%, a level of 400 V thereby producing a charge of −3.07 C, a density of 0.811 gm/cm$^3$, and an electrode spacing of 2.9 μm. An experimental implementation has been demonstrated for three flow cells containing magenta (Majestyk), and black and cyan emulsion aggregation (EA) toner, all sharing a single traveling wave grid. Toner transport has been achieved on a non-planar traveling wave grid wrapped around an Ultim roll. Striations were observed of cyan EA toner on the conductive portions of the traveling wave grid, which is 8-mil pitch at 50% duty cycle. Additionally, gated toner was observed distributed around a 50 um aperture.

The incorporation of aperture arrays into flow cells enables the provision of print head architectures that may be suitable for a BAM printer. Various exemplary embodiments are described as follows: single-shot color, two-shot color, and tandem color.

Figure 4:
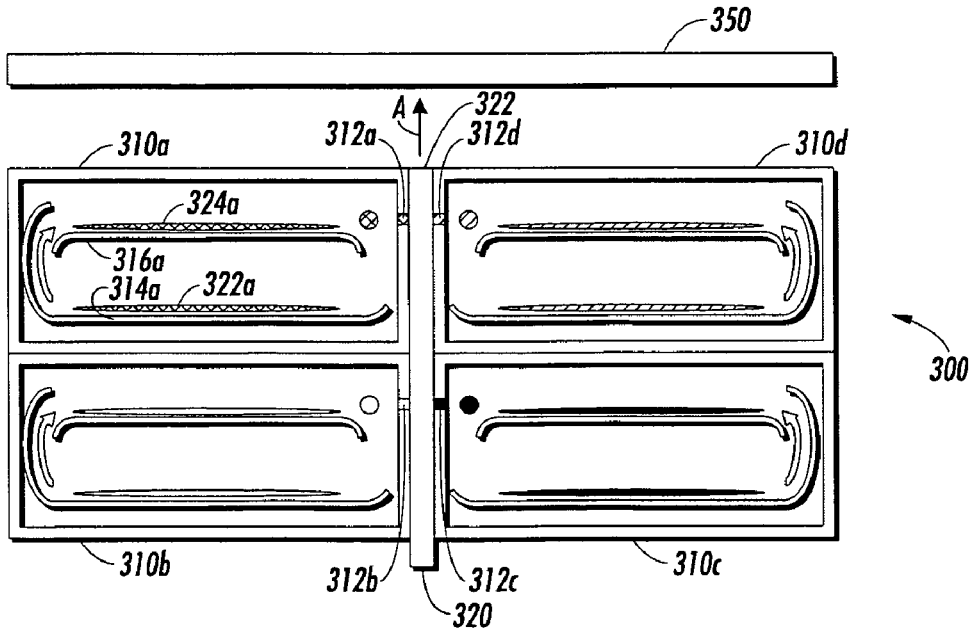
FIG. 4 is a schematic of an exemplary embodiment reservoir system.

An exemplary embodiment reservoir system for a single-shot color configuration is shown schematically in FIG. 4. In this embodiment, a single channel 320 utilizes four toner apertures, with two re-circulating toner cavities located on each side of the channel. Specifically, FIG. 4 depicts a single-shot color print head 300 comprising a channel 320 in communication with a reservoir 310*a*, 310*b*, 310*c*, and 310*d*; and a toner feed exit 312*a*, 312*b*, 312*c*, and 312*d* defined therein. Each of the feeds 312*a-d* administer toner to the channel 320 through which a stream of gas, designated by arrow A, flows. The channel 320 generally extends from a source of high pressure gas (not shown) to a channel exit 322. The toner, carried or otherwise entrained in the flow A, is subsequently deposited on a print medium 350, such as a drum or belt. Disposed within each reservoir is at least one traveling wave grid for transporting and in certain configurations, recirculating toner within the reservoir. The one or more traveling wave grids transport toner or other particulates from a hollow region within a reservoir to a location near a toner feed exit. For example, a first traveling wave grid 314*a* and a second traveling wave grid 316*a* are provided in reservoir 310*a*. The first grid 314*a* transports toner from a first region to a second region within the reservoir 310*a*. The second grid 316*a* transports toner within the reservoir 310*a*, and ideally from the second region to the first region. During operation and transport of toner within a reservoir, a toner "cloud" typically forms in proximity to each grid, such as shown for example by clouds 322*a* and 324*a* in FIG. 4.

Figure 5:
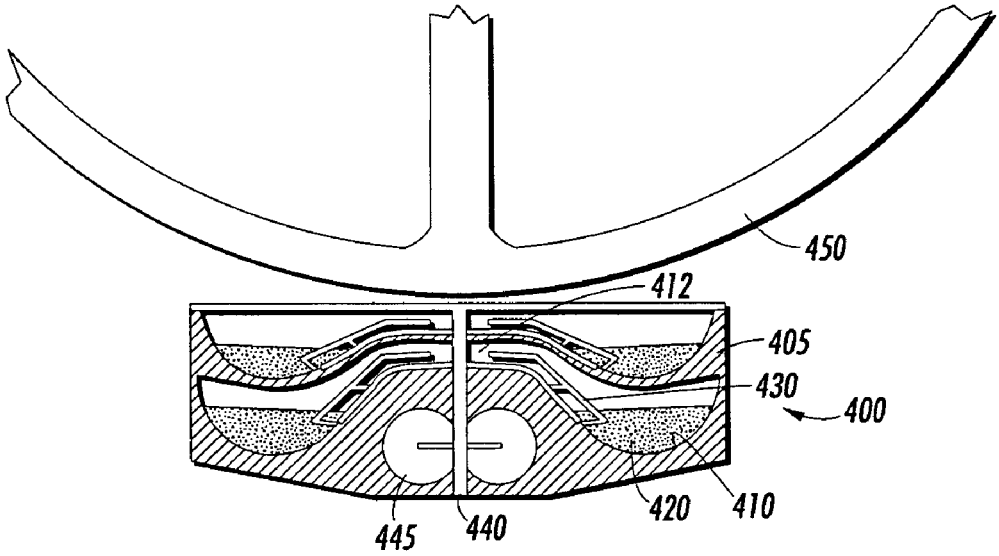
FIG. 5 is a schematic of another exemplary embodiment reservoir system.

To accommodate this single-shot CMYK configuration, a channel length of about 4 mm is utilized. "Channel length" as described herein is generally the distance from the location in the channel at which toner feed is suitably mixed, to the substrate or surface to which the toner is applied. Referring to FIG. 5, a schematic of an alternate exemplary embodiment reservoir system for a single-shot print head 400 is shown. The print head 400 comprises a body 405 which defines a plurality of toner reservoirs such as reservoir 410. A toner sump 420 is defined within the reservoir 410. A traveling wave grid member 430 transports toner from the sump 420 to a channel 440 through which gas such as air flows. A source of high pressure 445 is provided upstream of the location in the channel 440 at which toner from a reservoir is fed. Toner exits the reservoir 410 through a feed 412 at which it enters the channel 440. The toner is entrained or otherwise carried in the flowing gas stream in the channel 440 and subsequently deposited on a drum 450. A time delay in aperture gating can be utilized to allow for color premixing within the channel. Therefore, a major advantage is that color registration is not a problem. The channel 440 can be oriented to print upwards, for example up to 30 degrees from vertical, as gravity may be a factor for toner cloud generation and thus transport of the toner along a traveling wave grid. Toner is electrostatically gated on-demand. The traveling wave grid 430 can be provided in two over-lapping sections. In such a multi-section configuration, unused toner falls back onto a lower grid to be transported back to an upper grid. Toner in the flow cell is refilled periodically from a main reservoir (not shown) using a controlled transport mechanism.

The channel through which a flowing gas or medium travels and entrains or otherwise receives particles such as toner, can be defined in the same member or body as is defined the hollow reservoir. Alternately, the channel can be defined in a separate component or body, apart from or different than the reservoir.

In a two-shot color print head configuration, a print head is utilized that corresponds to the single-shot color configuration previously described, but with two channels and one toner supply on each side of each channel. Each channel has two re-circulating toner cavities, with one on each side. Full color requires two channels or two passes. This configuration allows the use of 2 mm channel lengths, and half the number of high voltage drivers. The channel can be utilized to print upward, up to 30 degrees from vertical, as gravity may be a factor for toner cloud generation.

Figure 6:
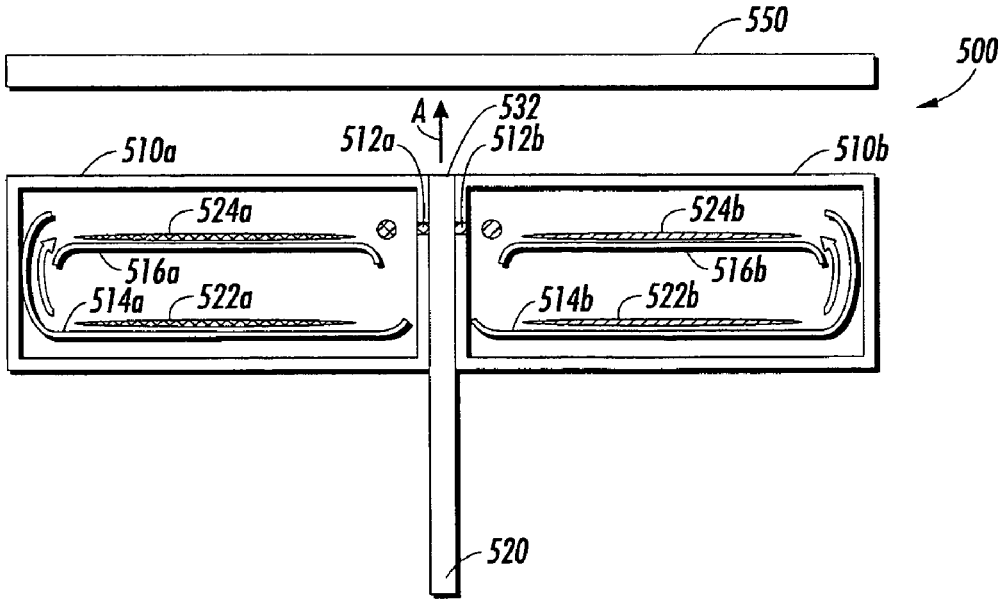
FIG. 6 is a schematic of another exemplary embodiment reservoir system.

A portion of an exemplary embodiment reservoir system for a two-shot color configuration is shown schematically in FIG. 6. Referring to FIG. 6, one half of a two-shot color print head 500 is shown. The portion shown comprises one channel, having reservoirs 510*a* and 510*b*; and toner feed exits 512*a* and 512*b* defined therein. The channel 520 extends from a source of high pressure gas (not shown) to a channel exit 532. Each of the reservoirs include a toner supply cell with traveling wave grids for transporting toner from a sump to the feed exit. It will be understood that for full color, two of the assemblies shown in FIG. 6 are utilized. Specifically, reservoir 510*a* includes a lower traveling wave grid 514*a* which transports toner to an upper traveling wave grid 516*a*. Reservoir 510*b* includes a lower traveling wave grid 514*b* which transports toner to an upper traveling wave grid 516*b*. During operation of the grids, toner clouds 522*a* and 524*a* reside on, and are generally transported on, grids 514*a* and 516*a*, respectively. Similarly, toner clouds 522*b* and 524*b* reside on, and are generally transported on, grids 514*b* and 516*b*, respectively. Each of the feeds 512*a* and 512*b* administer toner to a channel 520 through which a stream of gas, designated by arrow A, flows. The toner, carried or otherwise entrained in the flow A, is deposited on a print medium 550 such as a drum or belt.

Figure 7:
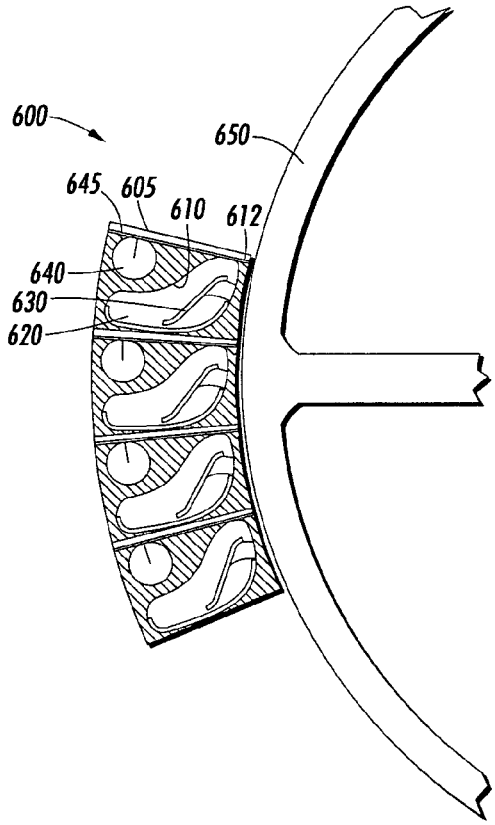
FIG. 7 is a schematic of yet another exemplary embodiment reservoir system.

An exemplary embodiment reservoir system for a tandem color configuration is also provided. A tandem color configuration uses one re-circulating toner supply per channel, with one color per channel, and four tandem channels for single pass color. FIG. 7 shows a quad print head arrangement. Time delay is incorporated into the gating to synchronize four color registration. Channel length may be 2 mm and the heads can print laterally or sideways. Referring to FIG. 7, a schematic of an alternate tandem color print head 600 is shown. The print head 600 comprises a body 605 which defines a plurality of toner reservoirs such as reservoir 610. A toner sump 620 is defined within the reservoir 610. A traveling wave guide member 630 transports toner from the sump 620 to a channel 645 through which gas such as air flows. A source of high pressure 640 is provided upstream of the location in the channel 645 at which toner from a reservoir is fed. The toner is entrained or otherwise carried in the flowing gas stream in the channel 645 and subsequently deposited on a drum 650. Toner exits the channel 645 at exit or aperture 612. The configuration of the other toner reservoirs generally corresponds to that of toner reservoir 610.

Figure 8:
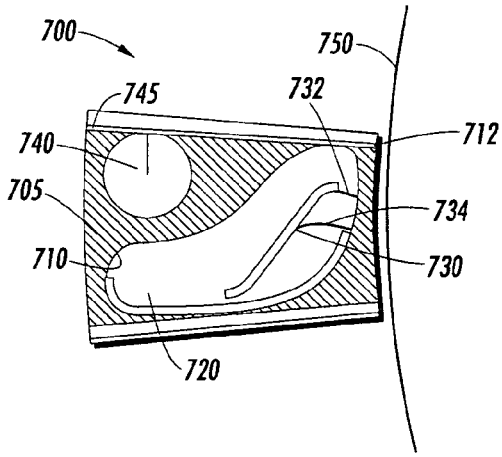
FIG. 8 is a schematic of another exemplary embodiment reservoir system.

FIG. 8 is a more detailed view of an individual flow cell having upper fluidization and lower return traveling wave grids. Specifically, FIG. 8 illustrates a print head 700 defining a reservoir 710 which defines a toner sump 720. The print head 700 includes a body 705, a channel 745 and pressure source 740. Toner is delivered from the sump 720 via a traveling wave grid 730 to an exit 712. Toner entrained in a flowing gas stream within the channel 745 is deposited upon a printing medium such as drum 750. Specifically, the traveling wave grid 730 includes an upper toner delivery leg 732 and a lower toner return leg 734.

In all of the exemplary embodiments described herein, a wide array of different configurations and arrangements of reservoir bodies, channels, high pressure gas sources, and traveling wave grids can be utilized. The systems described herein can employ one or more reservoirs in conjunction with a gas flow channel or member providing such. Alternately, each reservoir may be utilized with its own dedicated gas flow channel. Alternately, a plurality of sets of reservoirs and channels can be used. For example, two or more sets of a pair of reservoirs dedicated to a single channel can be used. FIG. 6 illustrates a pair of reservoirs and a dedicated channel.

Generally, the exemplary embodiment traveling wave grid assemblies include a traveling wave grid that is non-planar. Examples of such geometry include but are not limited to arcuate, curved, or linearly alternating or stepped configurations. The non-planar grid is positioned within a reservoir such that upon operation of the grid, the grid serves to recirculate and provide a continuous supply of particulates or material to a desired location. A significant advantage of this configuration is that it can reduce, and in certain applications, entirely eliminate, mechanical moving parts, such as may otherwise be required.

Experiments with several planar and non-planar traveling wave grid arrangements have shown that toner re-circulating transport is possible for the designed flow cells. In addition, the electrostatic fields for transport of toner has been modeled and quantified. Electrodynamics of toner gating have also been modeled and optimized to successfully guide experiments.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A reservoir system adapted for use in a printing system, the reservoir system comprising:

at least one member defining a hollow flow channel terminating at a channel exit;

a plurality of reservoir bodies, each reservoir body defining an interior hollow region adapted to store particles, the hollow region and the hollow flow channel being in flow communication through a particle feed exit; and a plurality of traveling wave grids, at least one of the plurality of traveling wave grids being disposed within the interior hollow region of a corresponding reservoir body and positioned and configured to transport particles in the hollow region of the corresponding reservoir body to a location proximate the particle feed exit by use of moving electrostatic fields that move across the plurality of traveling wave grids.

2. The reservoir system of claim 1 further comprising:

a source of high pressure gas, the source being in flow communication with the hollow flow channels defined in the members.

3. The reservoir system of claim 1 wherein the plurality of traveling wave grids include a collection of traveling wave electrodes.

4. A reservoir system adapted for use in a printing system, the reservoir system comprising:

a plurality of reservoir bodies, each body defining an interior hollow region adapted to store particles;

a plurality of corresponding gas channels, each gas channel dedicated to a respective reservoir body and in flow communication therewith through a particle feed exit; and a plurality of corresponding traveling wave grids, each traveling wave grid disposed in an interior hollow region defined within a respective reservoir body, wherein the traveling wave grids are adapted to transport the particles by use of moving electrostatic fields that move across the plurality of traveling wave grids.

5. The reservoir system of claim 4 further comprising:

a high pressure gas source in flow communication with the plurality of gas channels.

6. The reservoir system of claim 4 wherein each hollow region defined with a reservoir body defines a first location proximate the particle feed exit and a second location distal from the first location, each traveling wave grid including:

a first traveling wave leg adapted to transport particles to the second location; and a second traveling wave leg adapted to transport particles from the second location to the first location proximate the particle feed exit.

7. The reservoir system of claim 4 wherein the plurality of traveling wave grids include:

a substrate;

a plurality of traveling wave electrodes; and at least one buss disposed on the substrate and in electrical communication with at least a portion of the plurality of traveling wave electrodes.

* * * * *